United States Patent [19]

Halssig et al.

[11] Patent Number: 4,653,402

[45] Date of Patent: Mar. 31, 1987

[54] PROJECTILE FUSE

[75] Inventors: Andreas Halssig, Denkingen; Horst Moosmann, Schramberg; Walter Winterhalter, Tennenbronn; Günter Westphal, Hardt, all of Fed. Rep. of Germany

[73] Assignee: Gebruder Junghans GmbH, Schramberg, Fed. Rep. of Germany

[21] Appl. No.: 802,017

[22] Filed: Nov. 25, 1985

[30] Foreign Application Priority Data

Dec. 18, 1984 [DE] Fed. Rep. of Germany ..... 3446098

[51] Int. Cl.[4] ..... F42C 15/26; F42C 15/28

[52] U.S. Cl. ..... 102/245; 102/250; 102/255

[58] Field of Search ..... 102/238, 237, 232, 228, 102/250, 245, 255, 223

[56] References Cited

U.S. PATENT DOCUMENTS 2,938,463 5/1960 Jesse ..... 102/250

3,608,493 9/1971 Aske et al. ..... 102/250

3,919,941 11/1975 Breed et al. ..... 102/250

FOREIGN PATENT DOCUMENTS 2330013 11/1976 Fed. Rep. of Germany .

1256033 2/1961 France ..... 102/250

*Primary Examiner*—David H. Brown

*Attorney, Agent, or Firm*—Burns, Doane, Swecker & Mathis

[57] ABSTRACT

A projectile fuse includes a carrier for an igniter. The carrier is held in a safety position by a safety element, which under the effect of centrifugal force moves to release the carrier. The safety element comprises a piston guided in a bore formed in the fuse body. The bore is filled with a flowable medium. The piston is provided with an orifice for enabling the medium to flow from one end of the piston to the other under the effect of the centrifugal force. The medium thus brakes the movement of the piston and creates a time delay before the carrier is released.

8 Claims, 2 Drawing Figures

PROJECTILE FUSE

BACKGROUND AND OBJECTS OF THE INVENTION

The invention relates to a projectile fuse having a carrier for an igniter, and a safety element which releases the carrier under the effect of centrifugal force.

A projectile fuse of this type is described, for example, in DE-AS No. 23 30 013. The safety element comprises a spiral strip which in the safety position holds a firing pin by means of a spring clip. The firing pin blocks a carrier for the igniter means. The spiral strip expands under the effect of centrifugal force and the firing pin releases the carrier, which then rotates into its firing position.

It is an object of the invention to provide a projectile fuse of the afore-mentioned type, wherein the safety element is more insensitive to impacts and assures pre-barrel safety.

SUMMARY OF THE INVENTION

According to the invention, this object is attained in the case of a projectile fuse of the afore-mentioned type in that the safety element comprises a piston guided in a bore formed on the fuse body. The bore is filled with a flowable medium. The piston includes an orifice, the cross-section of which is smaller than the cross-section of the piston. The piston, under the effect of the centrifugal force, forces the medium from one end of the piston to its other end through the orifice.

When the projectile spins, the piston is urged radially outwardly. This movement is gradual, as the piston is being braked by the flowing medium. The piston moves at a rate which is a function of the volume of the medium being forced through the orifice. The safety element therefore moves away from and releases the igniter carrier after a certain time delay. The extent of the time delay depends on the cross-section of the passage orifice and the viscosity of the medium. A liquid is preferably used as the medium.

Impacts acting on the body of the projectile are attenuated by the medium, so that the igniter carrier is not released by the impact.

BRIEF DESCRIPTION OF THE DRAWING

The objects and advantages of the invention will become apparent from the following detailed description of a preferred embodiment thereof in connection with the accompanying drawings in which like numerals designate like elements, and in which.

DETAILED DESCRIPTION OF A PREFERRED EMBODIMENT OF THE INVENTION

Figure 1:
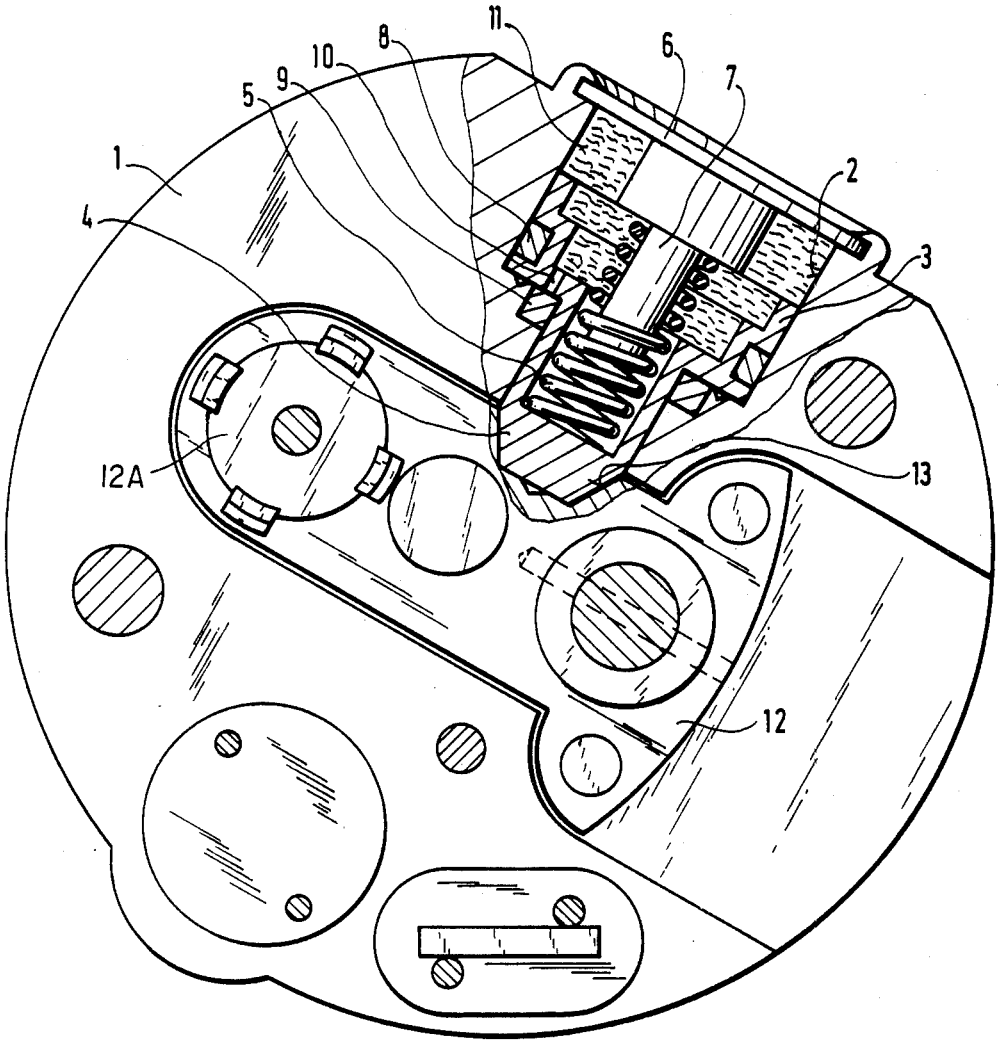
FIG. 1 depicts a projectile fuse in cross-section in the safety position.
Figure 2:
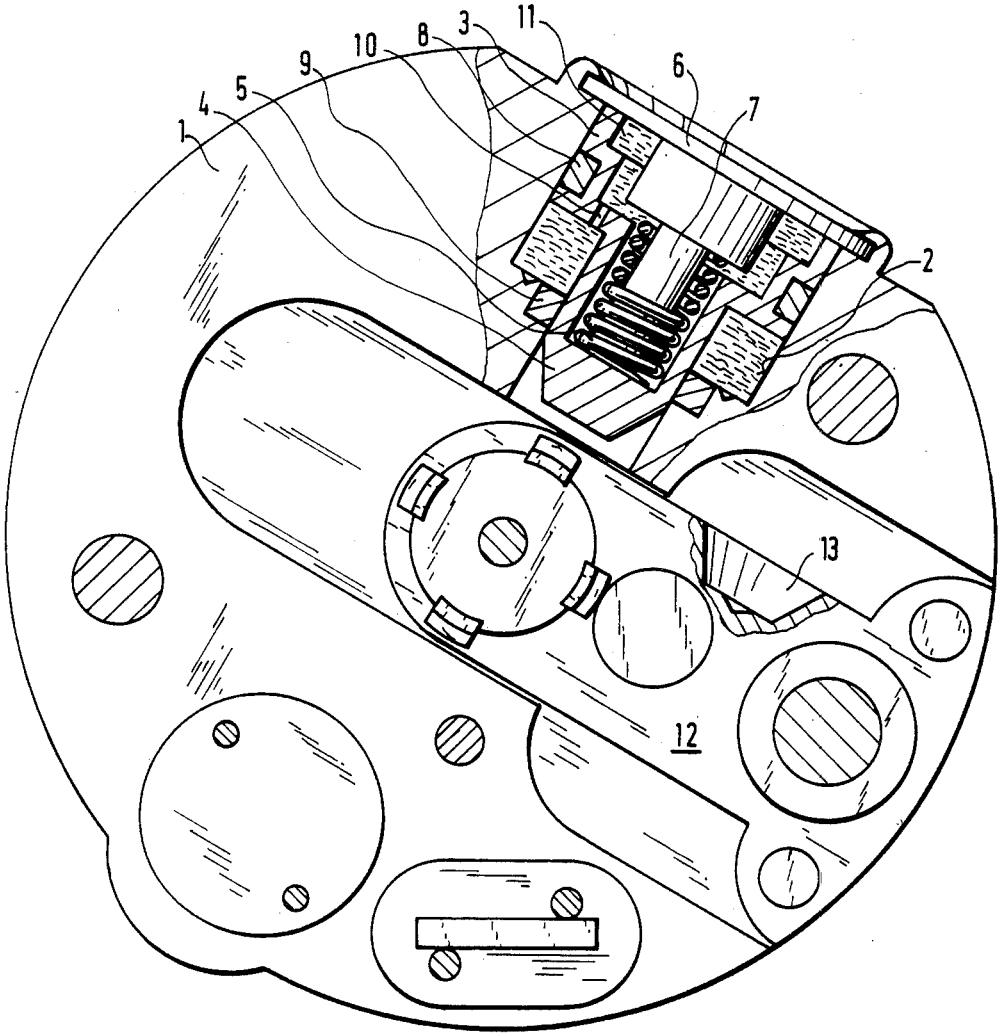
FIG. 2 is similar to FIG. 1 with the projectile fuse in the firing position.

A cylindrical bore or chamber 2 is formed in an igniter body 1. A piston 3 is supported in the bore 2.

A locking piece 4 is provided on the piston 3. A cover in the form of a sheet gasket 6 extends across the bore to close it off. A post or stud 7 is carried by the gasket 6 and projects toward the locking piece 3. The piston is recessed at its center to receive the stud. A compression spring 5 is seated in the locking piece 4, and extends over the stud 7. The spring 5 reacts between the sheet gasket 6 and the locking piece 4 to urge the latter away from the gasket 6.

The piston 3 is sealed off in the bore 2 by means of a ring 8. A seal ring 9 seals around the locking piece or projection 4. The piston 3 includes a passage orifice 10, the cross-section wehreof is substantially smaller than the cross-section of the piston 3. The bore 2 is filled with a liquid 11.

An igniter carrier 12 is located in the igniter body 1 for carrying an igniter (detonator) 12A. The igniter carrier includes a recess 13 engaged by the locking piece 4 when the carrier is in a safety position.

The mode of operation of the projectile fuse described above is as follows. If, while the fuse is in the safety position of FIG. 1, the fuse is caused to spin, the piston 3 migrates, under the effect of centrifugal force, in the outward direction against the force of the compression spring 5. Its movement is delayed by the liquid 11. The piston is able to move, per unit time, by a distance corresponding to the volume of the liquid 11 passing through the passage orifice 10.

After a certain time delay, for example, approximately 20 to 30 ms, the locking piece 4 of the piston 3 will have left the recess 13. Under the effect of the centrifugal force the igniter means carrier 12 then moves into the firing position in which ignition may be effected. In view of the braked piston movement, adequate pre-barrel safety is assured.

Short time impacts or jolts acting on the fuse body 1 are suppressed with regard to their effect on the piston 3 and the locking piece 4, as the liquid 11 attenuates the movement of the piston. Small displacements of the locking piece 4 are cancelled out by the compression spring 5.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A projectile fuse for use in a spinning-type projectile and comprising:
   - a fuse body,
   - a carrier disposed in said fuse body for supporting an igniter, said carrier being movable from a safety position to an operative position,
   - means for releasably retaining said carrier in said safety position and comprising:
     - a chamber formed in said fuse body and filled with a flowable medium, and
     - a piston mounted in said chamber and including means normally retaining said carrier in said safety position, said piston mounted for outward movement away from said carrier in response to the urgings of centrifugal force, said piston including an orifice having a cross-sectional area smaller than that of said piston, said orifice extending between opposite ends of said piston to conduct a flow of said medium therethrough when said piston is urged outwardly by centrifugal force, the rate of movement of said piston being a function of the rate of flow of said medium through said orifice to effect a time delay before said carrier is released.

2. Projectile fuse according to claim 1, wherein said medium is a liquid.

3. Projectile fuse according to claim 1, wherein said piston carries a seal ring which slidingly engages a wall of said chamber.

4. Projectile fuse according to claim 1, wherein said means retaining said carrier in said safety position comprises a projection of said piston which engages a recess in said carrier.

5. Projectile fuse according to claim 4 including a seal ring in a wall of said chamber surrounding said projection.

6. Projectile fuse according to claim 1 including spring means in said chamber for yieldably urging said piston toward said carrier.

7. Projectile fuse according to claim 6 including a cover closing an outer end of said chamber, said cover carrying a post extending toward said piston, said spring comprising a coil spring mounted on said post and acting between said cover and said piston.

8. Projectile fuse according to claim 7, wherein said piston is centrally recessed to receive said post.

* * * * *